United States Patent [19]

Jones

[11] Patent Number: 4,773,688

[45] Date of Patent: Sep. 27, 1988

[54] LOCOMOTIVE OIL COOLER PULLER NEEDING ONLY ONE SUSPENSION POINT

[76] Inventor: Harmon L. Jones, 7737 Kittrell La., Ooltewah, Tenn. 37363

[21] Appl. No.: 80,381

[22] Filed: Jul. 20, 1987

[51] Int. Cl.[4] ..... B66C 1/22

[52] U.S. Cl. ..... 294/67.22

[58] Field of Search ..... 294/6.1, 67.2, 67.21, 294/67.22, 67.5, 68.26, 86.41; 414/626, 684

[56] References Cited

U.S. PATENT DOCUMENTS

| | | | |
|---|---|---|---|
| 808,719 | 1/1906 | Bray | 294/67.2 |
| 969,154 | 9/1910 | Buckwalter | 294/67.2 |
| 1,115,106 | 10/1914 | Ramage | 294/67.21 |
| 2,165,921 | 7/1939 | Duda | 294/67.2 |
| 3,696,487 | 10/1972 | Mrugala et al. | 294/67.22 |
| 3,843,185 | 10/1974 | James et al. | 294/67.21 |
| 3,998,488 | 12/1976 | Durgan | 294/67.21 |
| 4,557,515 | 12/1985 | Read | 294/67.22 |

FOREIGN PATENT DOCUMENTS

| | | | |
|---|---|---|---|
| 701915 | 12/1979 | U.S.S.R. | 294/67.2 |
| 2156312 | 10/1985 | United Kingdom | 294/67.22 |

*Primary Examiner*—Johnny D. Cherry

[57] ABSTRACT

This invention is a device for removing an oil cooler from a diesel locomotive, having one suspension point, and having a laterally extending upper arm, a vertical arm, and a laterally extending lower arm that cradles and supports a laterally extending probe, which is attached in pivotal fashion to a pair of lifting plates that are removably affixed to the oil cooler. The upper arm has a lifting clevice attached to a point central to the load, and a counterweight that balances the device from that central point. When the device is lifted by crane or other methods from the lifting clevis, the oil cooler is balanced laterally while at the same time maintaining an acute angle similar to the angle that the oil cooler maintains when secured in the locomotive.

1 Claim, 3 Drawing Sheets

LOCOMOTIVE OIL COOLER PULLER NEEDING ONLY ONE SUSPENSION POINT

BACKGROUND OF THE INVENTION (new)

There presently exists in the field of locomotive repair and maintenance the need to safely and quickly remove oil coolers from diesel locomotives, such coolers being of large size, relatively heavy, and well above the floor of the locomotive. Due to the fact that such a cooler is positioned in an oil cooler "pocket" within the locomotive at an acute angle, with access to it being from the side of the locomotive, the cooler must maintain position at near such an acute angle when being removed from the locomotive. Because of this, and because the cooler is well above the floor level, the most commonly used means of removing the cooler is with a "home-made" pulling device that is suspended by a crane or other such means and secured to the side of the cooler, in a laterally extending manner, through a centered hole in the top of the cooler, with the said pulling device having a counterweight on its outer extremity that balances the load. Because the center of balance of the said pulling device differs between the loaded and unloaded status, it must of necessity have two suspension points, and before the cooler can be removed from the locomotive, the pulling device must be secured to the side of the cooler, after which the suspension joints are changed; then, while one man works with "jimmy bars" or other such leveraging tools in an effort to approximately maintain the acute angle of the cooler, the pulling device and the cooler are suspended as one and the cooler is removed laterally out of the oil cooler pocket of the locomotive. Due to the fact that the pulling device is secured to the cooler through the centered hole in top of the cooler, the cooler tends to gravitate toward a vertical position when the pulling device with its load is suspended. Thus it is apparent to someone skilled in the art that considerable physical strain is endured by the person attempting to force the said acute angle of the cooler that is needed to work the cooler laterally out of its pocket. Also, it is apparent that the spatial requirements of the laterally extending pulling device attached to the side of the cooler are such that a wall or other such obstruction located too close to the locomotive being repaired often prevents workers from removing the cooler from the locomotive. Other than make-do contrivances such as that described above, there is no dependable and safe invention for removing an oil cooler from a locomotive without removing the locomotive's hatch.

SUMMARY OF THE INVENTION

The locomotive oil cooler puller has one suspension point central to the load, with said load being attached to the locomotive oil cooler puller in swivel fashion by means of a set of angle adapter plates, which shift the oil cooler from what would be a normally vertical position when suspended to an acute angle when suspended. The said acute angle of the suspended oil cooler allows workers to remove said cooler from a locomotive with a minimum of effort and the solitary suspension point of the said puller allows the workers to remove the oil cooler without changing suspension points. Also, the position of the counterweight of the said puller, being above the oil cooler as opposed to the side of the oil cooler, allows for greater range of lateral movement of the oil cooler as it is being removed from the locomotive.

DESCRIPTION OF THE PREFERRED EMBODIMENT

Figure 1:
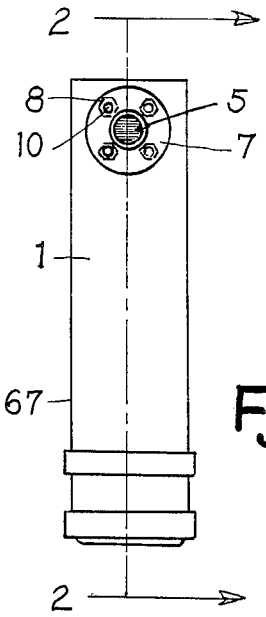
FIG. 1 is a side view of an oil cooler in an upright and vertical position, seen from its left side and along a vertical axis relative to its width.
Figure 2:
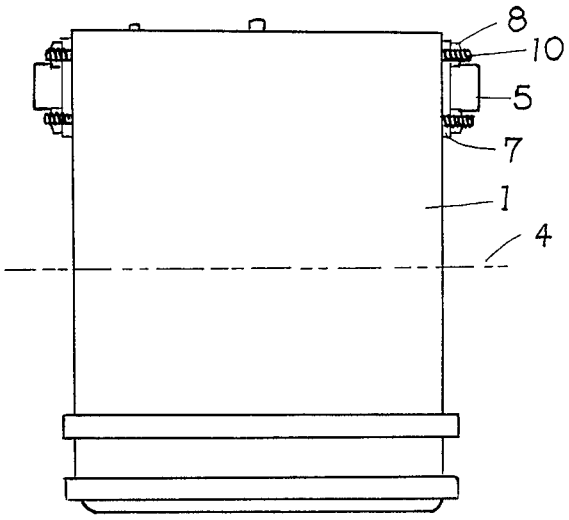
FIG. 2 is a frontal view of an oil cooler as seen taken on line 2 in FIG. 1, showing the horizontal axis relative to the length of the oil cooler with parts pertinent to the invention.
Figure 3:
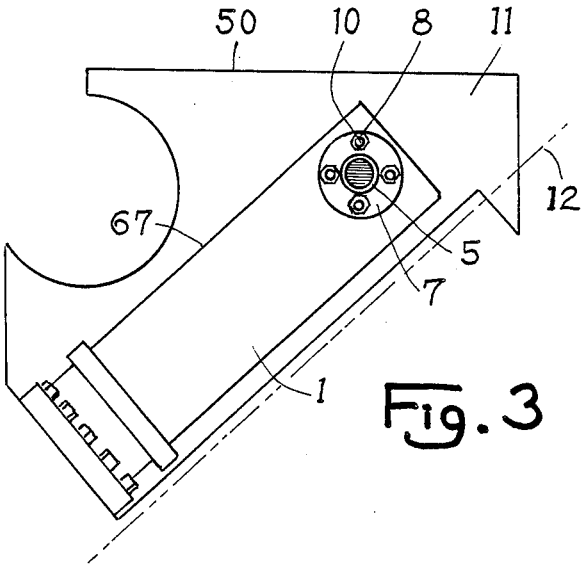
FIG. 3 is a left side view of an oil cooler as it sits in its pocket in a locomotive before the oil cooler puller is attached, showing the pocket angle and parts pertinent to the invention.
Figure 4:
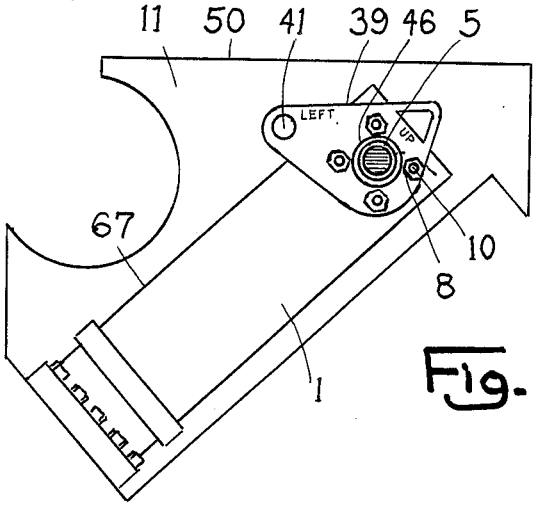
FIG. 4 is a left side view of an oil cooler as it sits in its pocket in a locomotive and showing the left angle adapter portion of the invention attached.
Figure 5:
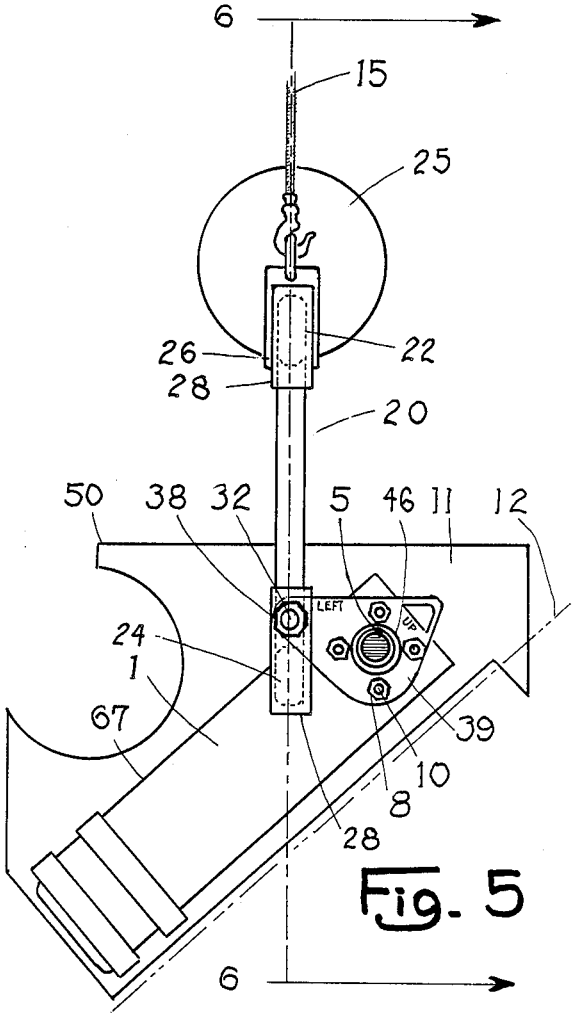
FIG. 5 is a left side view of the invention showing the puller applied and the angle adapters secured and hoisting an oil cooler in its pocket in the locomotive.
Figure 6:
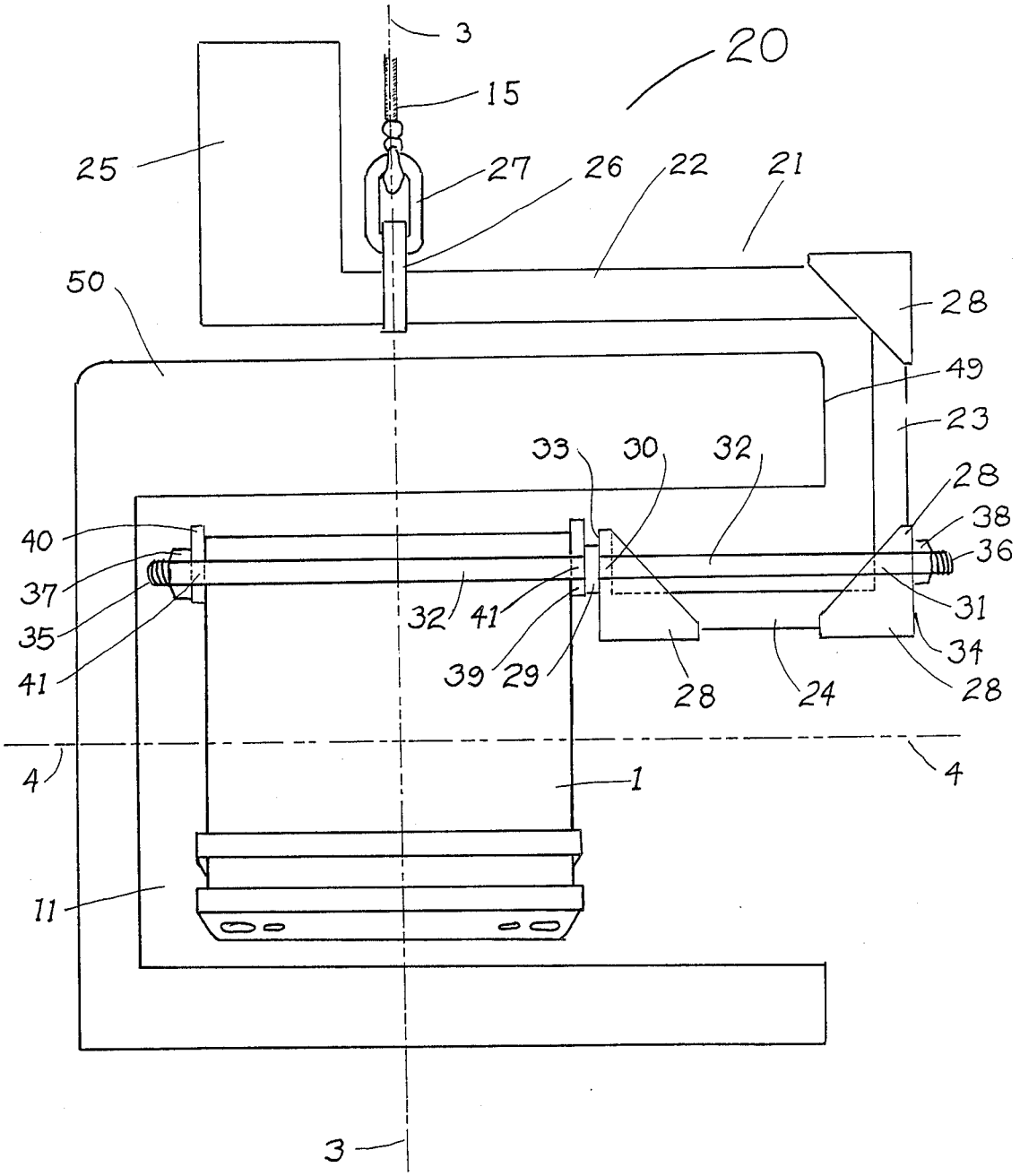
FIG. 6 is a frontal view of an oil cooler puller as seen from line 6 of FIG. 5 and attached to an oil cooler via the adapter plates and with the oil cooler hoisted in its pocket in a locomotive.

Referring to FIG. 6 of the drawings, an oil cooler puller 20 for a diesel locomotive 50 consists of a frame 21 that is suspended by means of a clevis 27 attached to a hoist plate 26 that is strategically centered over the oil cooler 1 on a vertical axis 3 of the oil cooler 1 relative to its length (and relative to the width of the locomotive). On the inner end of the upper arm 22 is affixed a counterweight 25 in such a manner that it will not foul against the locomotive 50, said counterweight 25 being the device that balances the oil cooler puller 20 on vertical axis 3 and horizontal axis 4. The lower arm 24 and outer arm 23 of the puller frame 21 has flanges 33 and 34 that are drilled at 30 and 31 to accommodate a probe 32, and all three corners of the frame 21 should have reinforcements 28, as these are critical stress areas. The above-mentioned probe 32 is a replaceable but otherwise a permanent attachment that is secured to the frame 21 by means of applying the probe 32 through the frame probe holes 30 and 31 until the probe flange 29 contacts the inner puller flange 33, at which point the outer probe nut 38 is tightened against the outer frame flange 34 on the outer threaded end 36 of the probe 32. Said probe 32 can thus be removed when it becomes necessary to renovate or replace it. Being, as stated above, a normally permanent attachment to the puller 20, the probe 32 is guided through a pair of angle adapters 39 and 40 that are secured to the oil cooler 1 in lieu of the water intake flanges 7 (as seen in FIGS. 1–3), and which provide a swivel point for the puller probe 32, with the left adapter 39 being mated flush with the probe flange 29, and the right adapter 40 being mated flush against the inner probe nut 37. When suspended, the invention will provide a balanced horizontal axis 4 of the oil cooler 1 relative to its length, which is necessary in removing the oil cooler 1 laterally from its pocket 11 in the locomotive 50. Referring more specifically to FIG. 5 of the drawings, said puller 20 is also designed so that the oil cooler 1 approximates the angle 12 of its pocket 11 in the locomotive 50 when said puller 20 and oil cooler 1 are suspended, such angle 12 being approximately 45 degrees from the vertical position along line 2 of the oil cooler 1 (as seen in FIG. 1). This is accomplished by transferring the customary hoist point at the water intake ears 5 approximately 11 inches toward the front 67 of the oil cooler 1 by means of the adapter plates 39 and 40, said adapter plates 39 and 40 having probe holes 41 (FIG. 4) at their forward ends that accommodate the probe 32 and that are of slightly larger dimension than said probe 32, thus creating a hoist point for the probe 32 that allows a swivel action, with the rear portions of the adapter plates 39 and 40 having a large hole 46 that is designed to accommodate the water intake ears 5 of the oil cooler 1 as seen in FIGS. 4 and 5 of the drawings, with the studs 10 passing through appropriately measured holes 43 (FIG. 8) in the angle adapters 39 and 40 and being secured to said angle adapters 39 and 40 by means of the water intake flange nuts 8, as seen in FIGS. 4 and 5.

Figure 7:
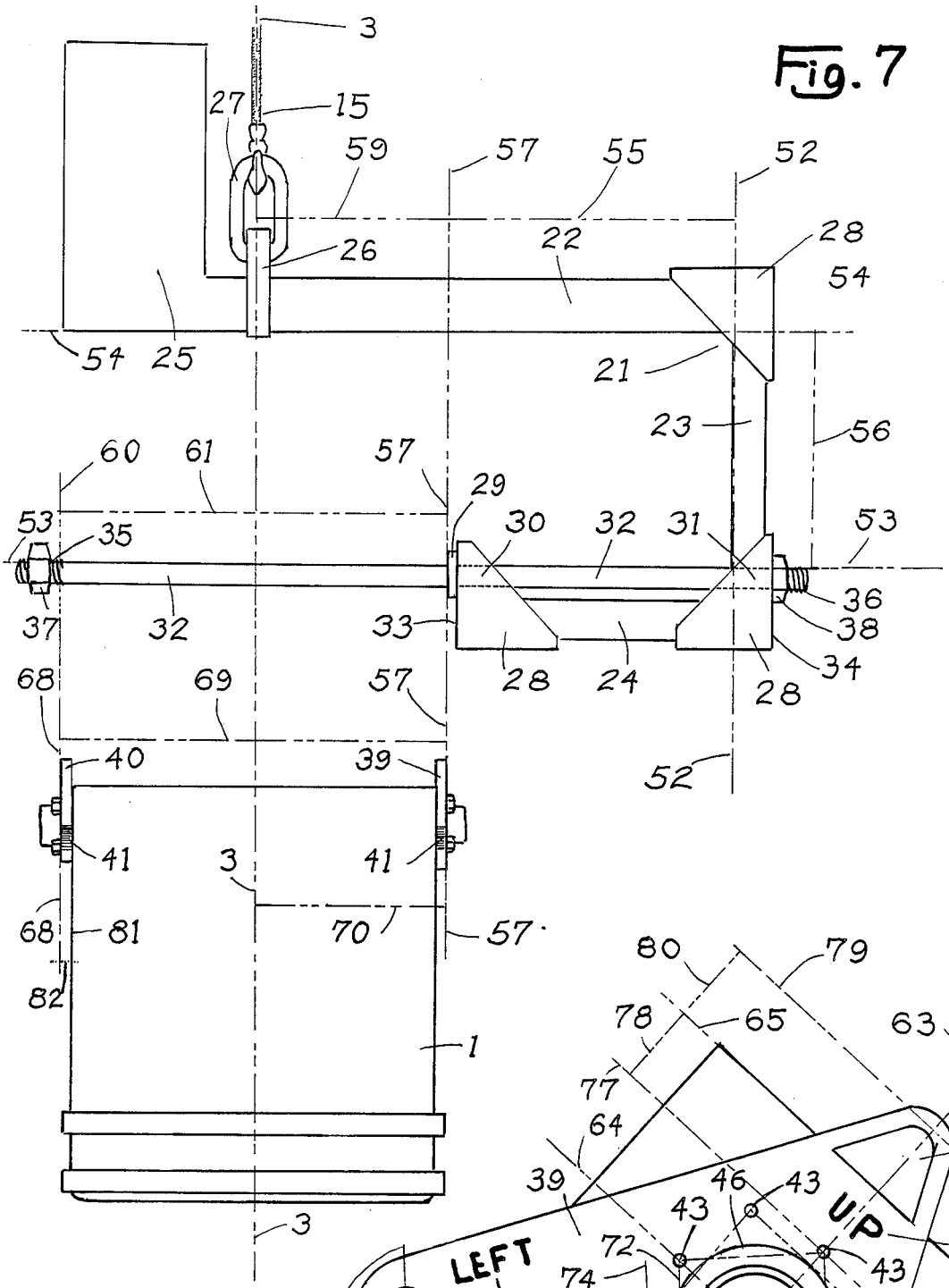
FIG. 7 is a frontal view of the puller detached from the oil cooler and angle adapters portion of the invention, and sharing a common vertical centerline, as they would when connected; showing dimensions vital to the invention.

Referring to FIG. 7 and thus the dimensions of the invention, it is essential that the measurements listed below are adhered to in order to assure the balances of the oil cooler 1 and the oil cooler puller 20 and thus the success of the invention. A general view of an oil cooler 1 with parts appurtenant to the invention are seen in FIGS. 1 and 2. FIG. 7 shows the oil cooler 1 separate from the puller 20, but with the vertical centerline and center of gravity 3 of the oil cooler 1 being in the same plane as the centerline 3 of the hoist plate 26, as indeed it would be when attached properly to the oil cooler puller 20 shown. This vertical centerline 3 of the oil cooler 1 is based on dimension 69, which is $38\frac{7}{8}$ inches from plane 57 to plane 68, said dimension 69 allowing for the adapter plates 39 and 40 after their attachment to the oil cooler 1, said adapter plates 39 and 40 being $\frac{3}{8}$ inch each and shown as dimension 82 in FIG. 7 as taken from planes 68 and 81. Halving the total of dimension 69, the centerline 3 of the oil cooler 1 is established as being 19 7/16 inches from plane 57 to plane 3, being shown as dimension 59 on the puller 20 and dimension 70 on the oil cooler 1. The probe 32 must be of such construction that its outer end 36, the end that is inserted into the lower arm 24 of the puller 20, will have ample thread protruding beyond the outer frame flange 34 to firmly secure the outer probe nut 38 to the probe 32, and dimension 61 should be $38\frac{7}{8}$ inches or thereabouts, said dimension being taken from plane 57, which represents the inner surface of the probe flange 29 to plane 60, which represents the beginning of the threaded surface 35 of the inner end of the probe 32. The probe 32 should extend from plane 60 enough to insure that the inner probe nut 37 can be safely snugged up against the right angle adapter 40 when the probe 32 is positioned through the angle adapters 39 and 40 in preparation to hoist the oil cooler 1. The probe 32 also should be of such dimension that it can be positioned into the probe holes 41 of the angle adapters 39 and 40 in a non-binding fashion, and should be constructed of such material and design that maximizes both strength and light weight for suspending a locomotive oil cooler 1 (some versions of these are as much as 800 lbs.), and the diameter of the probe flange 29 should be of such dimension that it is wider than the angle adapter probe holes 41 and the inner arm probe hole 30, and should be firmly affixed to the probe 32. The frame 21 of the puller 20 is to be of a strong and lightweight metal and of such design as to maximize its strength, with reinforcements 28 at its corners as per FIG. 7 and with dimension 55 being 27 inches and extending from plane 57 to plane 52, with plane 52 representing the inner surface of the outer arm 23 of the puller 20, said plane 52 having ample clearance between it and the outer edge of the locomotive hatch 49 (FIG. 6) when hooking the puller 20 to an oil cooler 1. Dimension 56 of FIG. 7 is 55 inches, taken from planes 53 and 54, with plane 53 representing the top of the probe 32 and plane 54 representing the bottom of the upper arm 22 of the puller 20, said dimension 56 also being necessary to assure clearance of the puller frame 21 from the locomotive 50 (FIG. 6) when connecting it to the cooler 1. The counterweight 25 should be constructed in such manner that all of its portions are attached to the upper arm 22 above plane 54 to insure locomotive 50 clearance (FIG. 6), and said counterweight 25 should be of such weight as to perfectly balance the puller 20 when the probe 32 is inserted into the lower arm 24 of the puller 20 and secured with the outer probe nut 38 and with the inner probe nut 37 threaded onto the inner probe threads 35 to a point abutting plane 60 of FIG. 7 and with the puller 20 suspended at 15 in solitary from its clevis 27.

Figure 8:
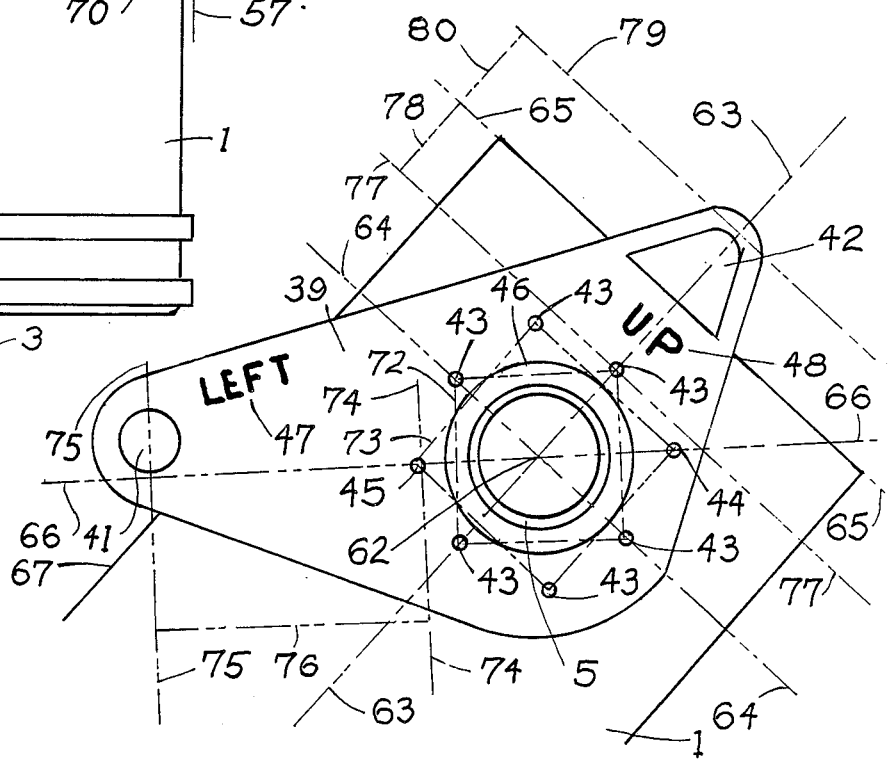
FIG. 8 is a side view of an angle adapter, showing dimensions vital to the invention.

Referring to FIG. 8 of the drawings, the angle adapter 39 or 40 is based on a water intake ear hole 46 that is $5\frac{3}{8}$ inches in diameter and is centered on vertical axis 63 and horizontal axis 64, which axes 63 and 64 in combination create center axis 62. Because there are two basic types of oil coolers 1 in use in most locomotives 50, it is necessary for convenience to design one basic angle adapter 39 and 40 that will fit both types of oil coolers 1, with the one angle adapter 39 and 40 design providing for the two differing water intake 5 flange stud patterns 72 and 73, one such pattern being the more common 5 5/16 inch stud pattern 73 and the other being a less common 4 15/16 inch stud pattern 72, with both types 72 and 73 using four studs 10 as seen in FIG. 1–5, centered around center axis 62 of the water intake ear 5; therefore, the angle adapter 39 or 40 will have eight stud holes 43, 13/32 inches in diameter, drilled in accordance to stud hole patterns 72 and 73, centered around axis 62, as seen in FIG. 8. The angle adapters 39 and 40 are equipped with two suspension points 41 and 42, said suspension points 41 and 42 being the probe hole 41 for use with the puller 20 and the vertical hoist hole 42 which can be utilized for suspending the oil cooler 1 in a vertical position without use of the puller 20. The bottom of the probe hole 41 should be positioned on plane 66 which is taken from the center of stud hole 44 across the center of stud hole 45, and the centerline 75 of the probe hole 41 should be 7 inches from plane 74, being seen as dimension 76 in FIG. 8 of the drawings. The bottom of the vertical hoist hole 42 should be on the same plane as the top 65 of the oil cooler 1 and the top of the vertical hoist hole 42 should be on horizontal plane 79 with dimension 80 being $2\frac{1}{2}$ inches. Dimension 78, taken between planes 65 and 77, should be 2 inches. The angle adapters 39 and 40 are of identical dimensions, the only difference between them being their markings 47 and 48, which prevents the workers from hooking them to the oil cooler 1 in an incorrect manner. These markings 47 and 48 are determined by positioning the angle adapter 39 or 40 over the oil cooler's 1 water intake flange studs 10 with the angle adapter 39 and 40 probe holes 41 pointing toward the front 67 of the oil cooler 1 and the angle adapter 39 and 40 vertical hoist hole 42 pointing toward the top 65 of the oil cooler 1 and stamped accordingly as the viewer would stand facing the respective right or left side of the oil cooler 1.

What is claimed is:

1. An apparatus for removing oil coolers from locomotives comprising an ordinarily upright and balanced lifting member which is provided at its lower end with a laterally extending and replaceable probe and a laterally extending support arm which cradles and gives support to said probe, with said probe extending beyond said support arm by such a length that an oil cooler can be pivotally attached to the probe, and means of attachment of said probe to an oil cooler, wherewith the oil cooler is pivotally attached to the probe and, when suspended by the apparatus, will maintain an acute angle.

* * * * *